US011229905B2

(12) United States Patent
Scordato et al.

(10) Patent No.: US 11,229,905 B2
(45) Date of Patent: Jan. 25, 2022

(54) METHOD AND APPARATUS FOR DISPENSING PRECISE ALIQUOTS OF LIQUID

(71) Applicant: Vistalab Technologies, Inc., Brewster, NY (US)

(72) Inventors: Richard E. Scordato, Pound Ridge, NY (US); Jeffrey Calhoun, Pleasantville, NY (US)

(73) Assignee: Vistalab Technologies, Inc., Brewster, NY (US)

( * ) Notice: Subject to any disclaimer, the term of this patent is extended or adjusted under 35 U.S.C. 154(b) by 342 days.

(21) Appl. No.: 16/419,800

(22) Filed: May 22, 2019

(65) Prior Publication Data

US 2019/0358624 A1 Nov. 28, 2019

Related U.S. Application Data

(60) Provisional application No. 62/675,323, filed on May 23, 2018.

(51) Int. Cl.
*B01L 3/02* (2006.01)

(52) U.S. Cl.
CPC ..... *B01L 3/0237* (2013.01); *B01L 3/0213* (2013.01); *B01L 3/0234* (2013.01); *B01L 2300/025* (2013.01); *B01L 2400/0487* (2013.01)

(58) Field of Classification Search
None
See application file for complete search history.

(56) References Cited

U.S. PATENT DOCUMENTS 4,406,170 A 9/1983 Kuhn
4,459,267 A * 7/1984 Bunce ..... B01L 3/021 222/207

(Continued)

FOREIGN PATENT DOCUMENTS

WO WO-2009067834 A3 * 9/2009 ..... B01L 3/0213

OTHER PUBLICATIONS

International Search Report and Written Opinion issued in related International Patent Application No. PCT/US2019/033785 dated Aug. 2, 2019.

*Primary Examiner* — Kathryn Wright
(74) *Attorney, Agent, or Firm* — Venable LLP; Michele V. Frank

(57) ABSTRACT

A pipette controller for aspirating and dispensing multiple aliquots of a fluid from a reservoir of fluid. The pipette controller can include a pipette holder adapted to operatively connect a pipette to the pipette holder; a pump having a vacuum port and a pressure port, the pump pneumatically connected to the pipette holder; an aspirate valve that controls airflow between the vacuum port and the pipette holder; a dispense valve that controls airflow between the pressure port and the pipette holder; a piston chamber; an aliquot dispense pump including a piston having a shaft that extends into the piston chamber, the shaft defining a stroke length; and an aliquot check valve that connects the pipette holder and the aliquot dispense pump; wherein the aliquot valve opens to allow airflow into the pipette holder upon engagement of the aliquot dispense valve. The pipette controller can also include a piston pump pneumatically connected to the pipette holder configured to deliver a bolus of air to the pipette holder.

13 Claims, 6 Drawing Sheets

(56) References Cited

U.S. PATENT DOCUMENTS

| | | | | |
|---|---|---|---|---|
| 4,821,586 | A | 4/1989 | Scordato et al. | |
| 5,090,255 | A * | 2/1992 | Kenney | B01L 3/0227 422/926 |
| 5,474,744 | A | 12/1995 | Lerch | |
| 7,396,512 | B2 | 7/2008 | DiTrolio et al. | |
| 10,189,018 | B2 | 1/2019 | Kozlenko et al. | |
| 2002/0001675 | A1 | 1/2002 | Tisone | |
| 2005/0095723 | A1 | 5/2005 | DiTrolio et al. | |
| 2008/0227663 | A1 | 9/2008 | Tisone et al. | |
| 2010/0020126 | A1 | 1/2010 | Takahashi | |
| 2013/0064693 | A1 | 3/2013 | Tschanz | |

* cited by examiner

METHOD AND APPARATUS FOR DISPENSING PRECISE ALIQUOTS OF LIQUID

CROSS-REFERENCE TO RELATED APPLICATION

The application claims priority to U.S. Provisional Application No. 62/675,323 filed May 23, 2018, the entire contents of which are hereby incorporated by reference.

BACKGROUND OF THE INVENTION

Field of Invention

This patent application relates generally to a method and apparatus for precisely dispensing multiple aliquots of a fluid from a reservoir of fluid or precisely aspirating aliquots of fluid into said reservoir. The fluid in the reservoir can alternatively be manually aspirated and dispensed by the apparatus. The volume of the aliquot can readily be varied. This invention has particular application in laboratory practice for aspirating a quantity of fluid into a serological pipette and then dispensing precise aliquots of the fluid.

Background

Serological pipettes are widely used for liquid measurement and dispensing in laboratories that perform, for example, drug development, environmental testing, and diagnostic testing. These pipettes can be described as glass or plastic straws, and can be, for example, approximately 30 cm long with graduations printed on them. Traditionally, liquid was drawn into these pipettes by applying suction to the top end by mouth or a rubber bulb. Liquid is measured by aspirating to a graduation line, and then dispensed by removing the suction. Current practice often employs a pipette controller such as a Drummond Scientific Pipette-Aid or a BrandTech Scientific acu-jet Pro Pipette Controller which use a small battery powered air pump and trigger-style pneumatic valves to manipulate pressure inside of serological pipettes to draw up and expel liquid.

Frequently, multiple aliquots of a sample must be dispensed for the analytical process. To do this the user first aspirates slightly more than the required volume and then slowly dispenses sample until the meniscus of the fluid aligns with a graduation line on the serological pipette. This is the starting volume. The user must note this reading and then dispense fluid until the meniscus drops to the graduation line corresponding to the difference between the starting volume and the desired dispense volume. If another aliquot is required, the user dispenses again to the graduation line corresponding to the difference between the prior reading and the desired volume. This methodology has problems. It is time consuming because the meniscus must be carefully read for each dispense. This requires holding the pipette controller very steady while reading the meniscus and simultaneously dispensing into the correct test vessel. This is a time consuming and fatiguing process when it must be repeated many times.

There are also multiple sources of error with the above described method: the meniscus must be read twice to obtain an accurate reading, and the user must subtract the first reading from the second reading. This is easy when a common volume like 1 ml is needed, but difficult for repetitive dispensing of 1.3 ml, for example. There is also an error associated with taking the difference between two larger numbers. For example, one can read a 25 ml serological pipette to an accuracy of 0.25 ml or 1%. However, if one attempts to dispense 25 aliquots of 1 ml this 0.25 ml error translates to a potential error of 0.5 ml since two readings are required. This is an error of 50% which is not acceptable for most analyses.

Previous methods to dispense multiple aliquots of fluid have depended upon methods that are cumbersome and lack flexibility. For example, U.S. Pat. No. 4,406,170 describes a device that can dispense aliquots from a syringe. This device can be quite accurate; however, it requires the use of syringes which are more expensive than serological pipettes, are harder to load into the device, do not easily enable the range of volumes, and cannot reach into vessels that require a longer length.

Piston operated, air-displacement pipettes such as one described in U.S. Pat. No. 4,821,586 are capable of dispensing multiple aliquots. However, this method requires a piston displacement that is equal to the volume to be aspirated. Serological pipettes are often used to aspirate 50 ml. This method requires a large and impractically sized piston to aspirate this large of a volume. In addition, the range of volumes that can be dispensed accurately is limited because of the air contained between the liquid sample and the piston—the "dead volume." As the dead volume increases, the accuracy decreases. This method therefore requires several sizes of pistons to accurately dispense the normal volumes used in a laboratory.

U.S. Pat. No. 7,396,512 attempts to overcome the above difficulties by controlling the time that air flows into a serological pipette to control the volume dispensed. Pressures on both sides of the valve are monitored. This design has several fundamental shortcomings. One shortcoming is that the volume dispensed will be decreased if the back pressure from the serological pipette is increased by, for example, the tip of the serological pipette being partially occluded by a vessel wall or if the tip is immersed in fluid. The flow is also dependent upon the viscosity of the liquid dispensed. Another difficulty is that the delivered volume is dependent upon the size of serological pipette attached to the device. This means that the user must inform the device of the size pipette being used. In most labs, serological pipettes are disposable and changed constantly, oftentimes with a different volume capacity. This device requires the user to enter the volume and the manufacturer of the serological pipette to obtain accurate results. This is time consuming and an impractical burden on the user.

Therefore, what is required is a pipette controller that can aspirate a relatively larger volume of fluid into a serological pipette and then quickly and accurately dispense a series of smaller aliquots by depressing a button. In addition, the volume of the aliquot can be easily set, and the volume dispensed is not dependent upon the size of serological pipette that is mounted to the pipette controller, the viscosity of the sample, or how the sample is dispensed.

SUMMARY

According to an embodiment, a pipette controller is disclosed comprising: a pipette holder adapted to operatively connect a pipette to the pipette controller; a pump having a vacuum port and a pressure port, the pump pneumatically connected to the pipette holder; an aspirate valve that controls airflow between the vacuum port and the pipette holder; a dispense valve that controls airflow between the pressure port and the pipette holder; a piston chamber; an aliquot dispense pump including a piston having a shaft that extends into the piston chamber, the shaft defining a stroke length; and an aliquot check valve that connects the pipette holder and the aliquot dispense pump; wherein the aliquot check valve opens to allow airflow into the pipette holder upon engagement of the aliquot dispense valve.

According to another embodiment, a method for delivering fluid from a pipette using a pipette controller is disclosed comprising: selecting an aliquot volume to be dispensed; determining an amount of air to insert into the pipette to dispense a volume of fluid equal to the selected aliquot volume; determining a number of steps delivered by a stepper motor to drive a piston in a piston chamber to deliver the amount of air into the pipette; and opening an aliquot valve to allow airflow from the piston chamber into the pipette, the airflow dispensing the fluid from the pipette.

A method and apparatus are disclosed that can aspirate fluid into a vessel such as a serological pipette and dispense a series of aliquots. According to embodiments, the apparatus can be a hand-held device configured like a pistol which employs a rubber seal to mount a serological pipette. According to an embodiment, controls for manual aspiration, manual dispense, aliquot dispense, and aliquot volume are provided. A pump can provide suction for aspirating fluid and pressure for dispensing fluid from the serological pipette. An aspirate control operates valves that connect pump inlet, the vacuum port of the pump, to the pipette, and a dispense control operates a valve(s) that connect pump outlet, the pressure port of the pump, to the pipette.

A separate aliquot dispense pump can be provided. In an embodiment, the aliquot dispense pump is a piston pump that delivers a measured bolus of air through a check valve to the serological pipette with each stroke of the piston. The bolus of air causes a measured aliquot of fluid to be dispensed from the serological pipette. Repeated aliquots can be dispensed by repeated actuation of the pump. The size of the bolus of air, and hence the aliquot volume, can be varied by changing the stroke length of the piston. Changing the stroke length of the piston can be achieved by a threaded stop to the piston stroke. The stop position relative to the piston can be, for example, varied by rotating a control that moves the threaded stop. A dial or counter can be actuated by the rotating control to provide an indication of the volume to be dispensed. This control can also actuate the aliquot pump by manually depressing the control to move the piston.

According to an embodiment, the aliquot dispense pump can be driven by a stepper motor. The number of steps by the motor determines the stroke length, and hence the aliquot volume of fluid delivered. A user control informs a processor of the desired aliquot volume, and the processor controls the stepper motor to deliver the number of steps required for the desired aliquot volume. This embodiment allows a different volume to be delivered with each aliquot. For example, the first aliquot could be 1 ml, the second aliquot 2 ml, etc.

According to an embodiment, pressure sensors can detect atmospheric pressure and/or pressure in the serological pipette and/or the piston chamber. Greater accuracy of aliquot volume can be achieved by modifying the number steps for a particular aliquot volume depending upon the atmospheric pressure and/or the pressure(s) in the serological pipette. This modification can be determined by mathematical formula or table values determined either experimentally and/or theoretically. The processor can also count the number of aliquots dispensed and apply a correction factor for the remaining volume in the pipette.

According to an embodiment, a position sensor can determine the angle at which the pipette is being held. The number of steps for an aliquot can be modified to compensate for this angle.

According to an embodiment, a DC motor with a drive system such as a cam can be used to drive the piston pump.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments of the invention are discussed in detail below. While specific embodiments are discussed, it should be understood that this is done for illustration purposes only. A person skilled in the relevant art will recognize that other components and configurations can be used without departing from the spirit and scope of the invention.

Although the term "pipette" and "pipette controller" can be used to describe embodiments of the invention, a person skilled in the relevant art will recognize that other devices that aspirate fluids can be used without departing from the spirit and scope of the invention.

Figure 1:
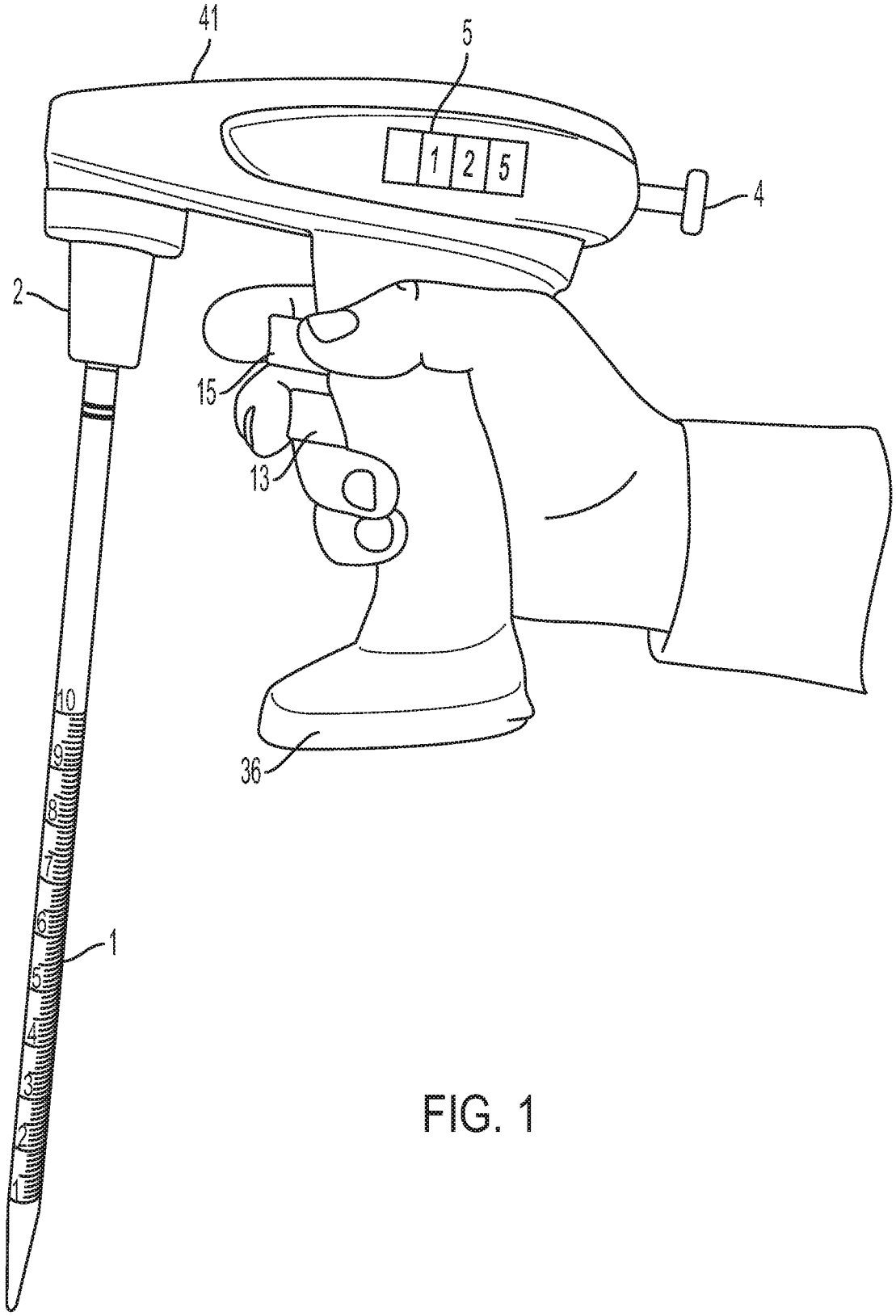
FIG. 1 is a side view of an embodiment of the invention employing manual dispensing of aliquoted fluid.
Figure 3:
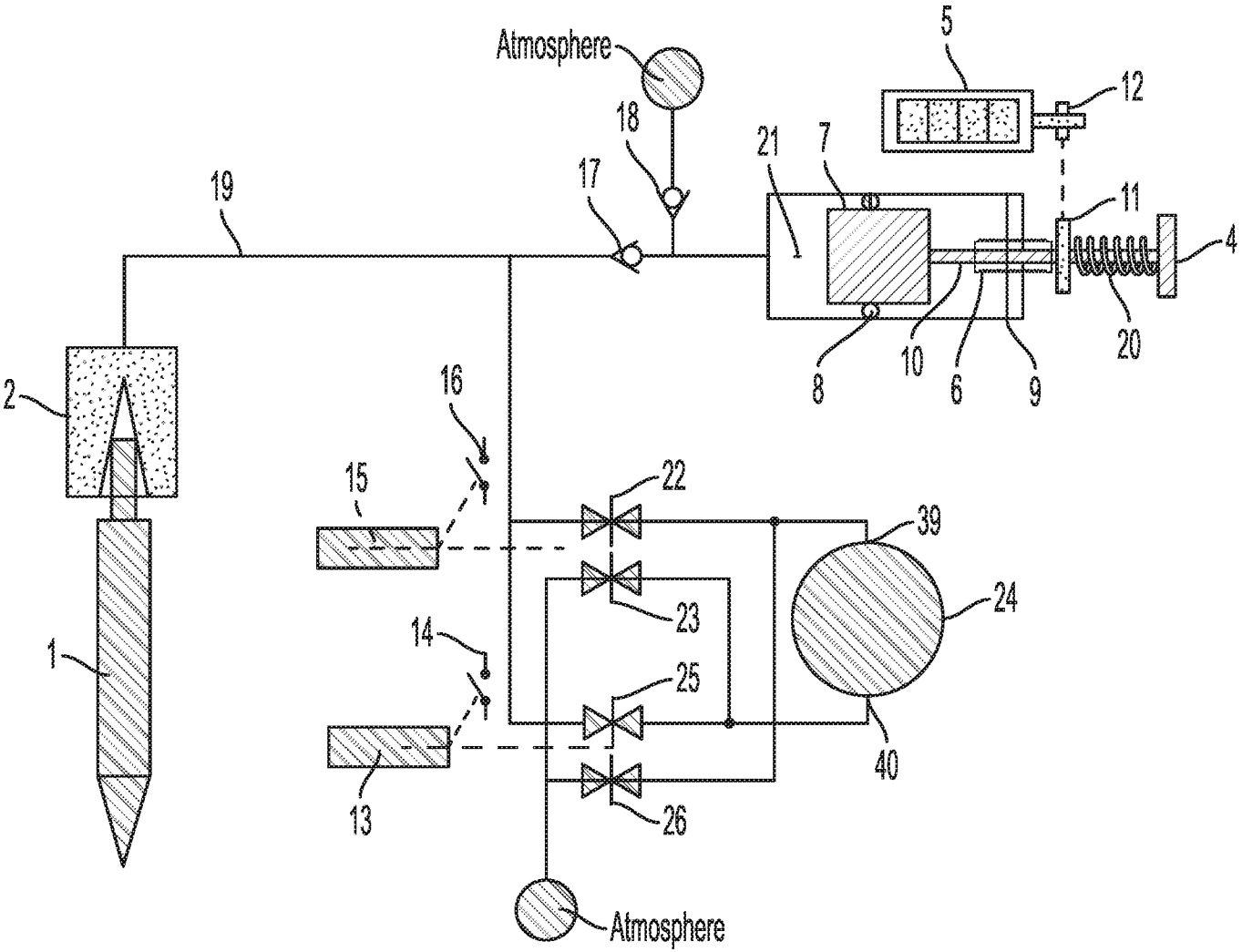
FIG. 3 is a schematic diagram of the manual dispensing embodiment of FIG. 1.

FIGS. 1 and 3 show embodiments of pipette controller 41. Serological pipette 1 is removably connected to pipette controller 41 by cone seal 2 which provides an air tight seal. Aspirate control 15 and dispense control 13 enable the user to aspirate and dispense fluid into pipette 1, by pneumatically connecting the pump inlet port 39 or pump outlet port 40, respectively, of pump 24 (see FIGS. 3-5). The speed of aspiration and dispense can be varied by the amount of finger pressure applied to aspirate control 15 and dispense control 13, respectively. Aliquot control 4 (FIG. 1) can set the aliquot volume desired by rotating the control. Mechanical display 5 can be a counter wheel assembly such that rotating the aliquot control 4 changes the reading of mechanical display 5. Referring to FIG. 3, rotation of aliquot control 4 can rotate the plunger drive gear 11 which in turn rotates the volume display drive gear 12 which then changes the mechanical display 5. Rotation of aliquot control 4 also rotates threaded stop 6 which moves the threaded stop 6 axially along the axis of plunger shaft 10 and plunger 7. When plunger stop 6 moves toward the distal end of plunger housing 9, the stroke of plunger 7 is shortened and the volume of air delivered with each stroke of the plunger to pipette 1 is reduced. The threaded stop 6 and plunger drive gear 11 can be driven by a spline on plunger shaft 10 so that the plunger shaft 10 can move axially through the stop 6 and plunger drive gear 11 to actuate plunger 7. Chamber 21 can be sealed from the atmosphere by seal 8. Finger pressure on aliquot control 4 moves plunger 7 inside plunger housing 9, compresses the air in chamber 21 and forces air through check valve 17, air tube 19 and cone seal 2 into pipette 1. When finger pressure is released from aliquot control 4, return spring 20 returns plunger 7 to its resting state. This action causes a partial vacuum in chamber 21 which refills the chamber 21 with air from the atmosphere through check valve 18. According to embodiments, the diameter of plunger 7 and maximum stroke length of the plunger 7 set by threaded stop 6 can be sized to displace about 5 ml, though this can be sized for much smaller or larger volumes. In an embodiment with a maximum displacement of 5 ml, a minimum stroke length can displace about 1/10 of this volume, 0.5 ml. This provides the ability to repetitively dispense aliquots from 0.5 ml to 5 ml. For a commonly used 25 ml serological pipette, this embodiment enables from 5 to 50 aliquots depending upon the aliquot volume selected. According to embodiments, the pipette controller can repetitively dispense aliquots from about 0.05 ml to about 25 ml. In some embodiments, the pipette controller can repetitively dispense aliquots of at least 0.1 ml. In some embodiments, the pipette controller can respectively dispense aliquots of at most 25 ml. In some embodiments, the pipette controller can repetitively dispense successive aliquots of about the same volume. In some embodiments, the pipette controller can repetitively dispense successive aliquots of different volumes.

According to embodiments, when aspirate control 15 is depressed it engages aspirate switch 16 and aspirate valves 22 and 23 which are normally closed. When engaged by aspirate control 15, aspirate valve 23 opens connecting the output 40 of pump 24 to the atmosphere, and aspirate valve 22 opens connecting the pump input 39 of pump 24 to the pipette 1 via air tube 19 and cone seal 2. Aspirate switch 16 turns on pump 24. This causes suction to be applied to pipette 1 which will draw fluid into the pipette. Aspirate valve 22 and/or 23 can be variable valves such that the amount of pressure or displacement on aspirate control 15 varies the degree of opening of the valve which in turn controls the speed of aspiration of fluid into pipette 1. According to embodiments, alternatively, aspirate switch 16 can be replaced with a rheostat or digital position sensor which can vary the aspirating speed by changing the speed of pump 24. According to embodiments, dispense control 13 can open dispense valves 25 and 26, reversing the function of the aspirate valves 22 and 23 by connecting the pump inlet 39 of pump 24 to atmosphere and the pump outlet 40 to pipette 1. Dispense control 13 energizes dispense switch 14 which turns on pump 24 and causes fluid to be dispensed from pipette 1. Pump 24 can be, for example, a diaphragm pump that can be operated by battery power such as YLK-Tech DA31SDC.

Figure 2:
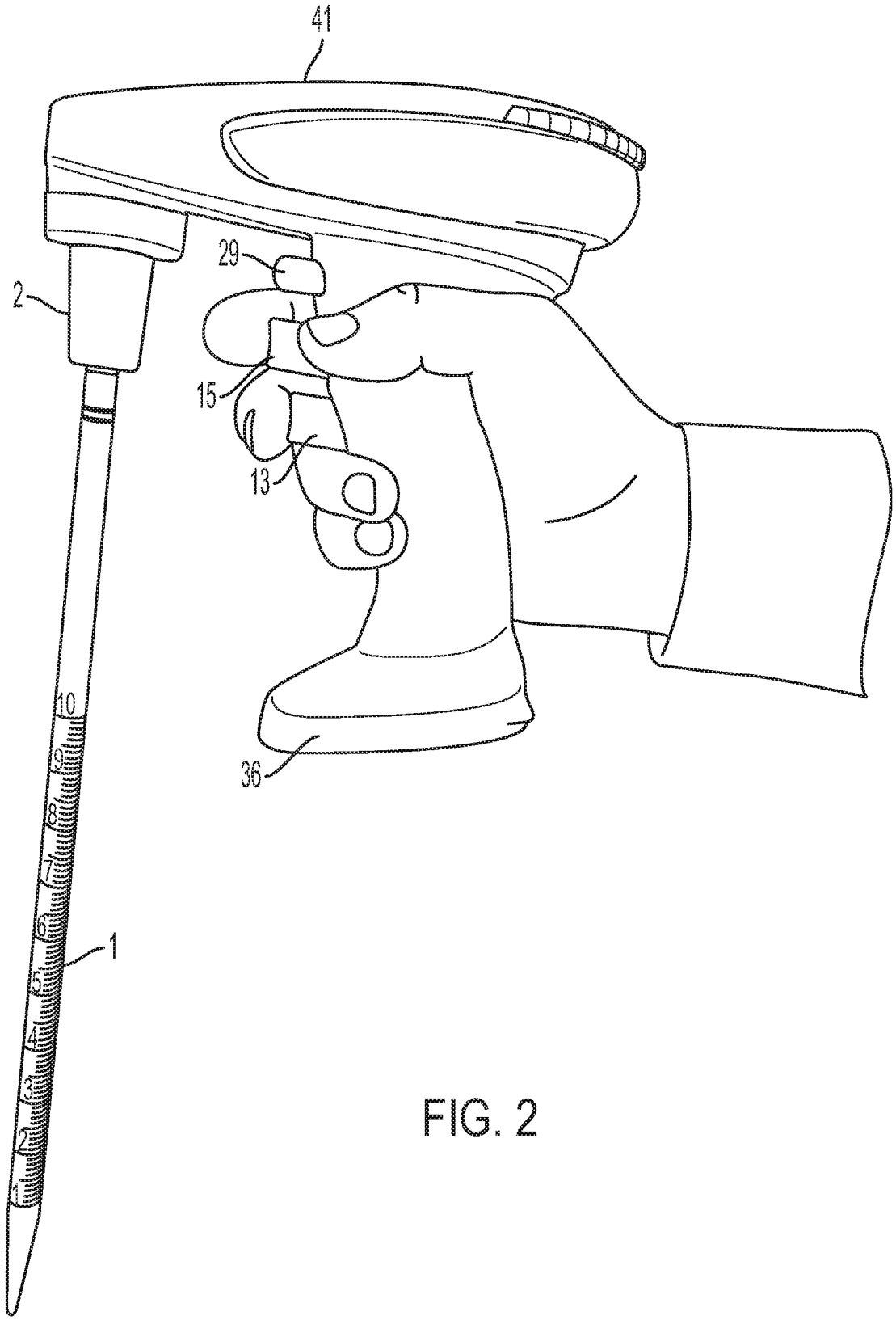
FIG. 2 is a side view of an embodiment of the invention employing motor driven dispensing of aliquoted fluid.
Figure 4:
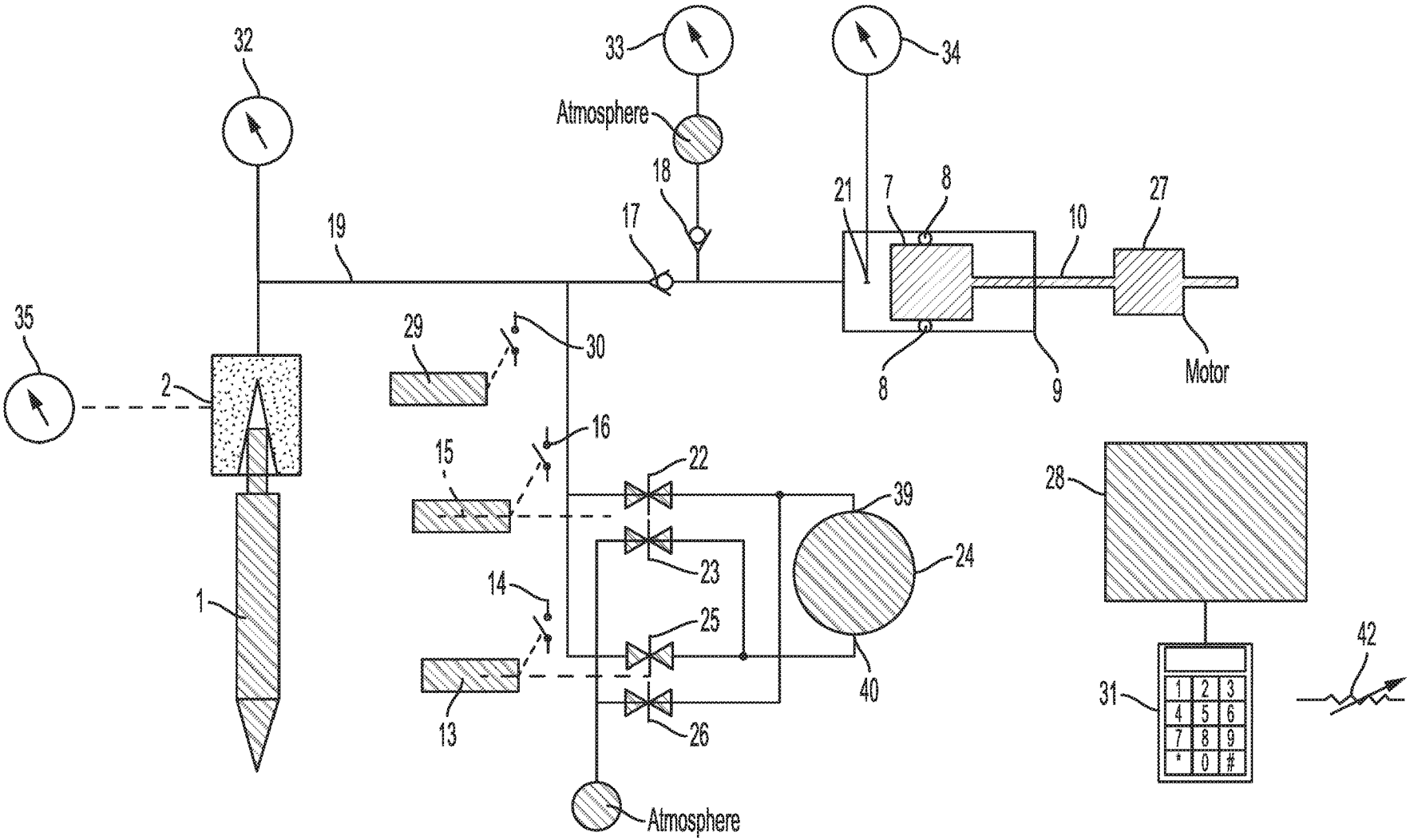
FIG. 4 is a schematic diagram of the motor driven dispensing embodiment of FIG. 2.

FIGS. 2 and 4 show an embodiment of a pipette controller 41 that uses aliquot motor 27 to move plunger 7 within the plunger housing 9. The aliquot motor can be a stepper motor with a threaded armature that engages with a threaded plunger shaft 10. Rotation of aliquot motor 27 will move the plunger shaft 10 and plunger 7 linearly within the plunger housing 9. Chamber 21 is sealed from the atmosphere by seal 8. Movement of plunger 7 can expel air from chamber 21 into pipette 1 and refill chamber 21 with atmospheric air as described above. Operation of aliquot motor 27 can be controlled by CPU 28. CPU 28 can be, for example, an Atmel ATMEGA32U4. Initiation of an aliquot can occur by depressing aliquot control 29 which actuates aliquot switch 30, which in turn informs CPU 28. The desired aliquot volume may be set from aliquot volume control 42. CPU 28 then rotates aliquot motor 27 the number of steps to move the plunger shaft 10 and plunger 7 that will aliquot the desired volume(s). Aliquot volume control 42 can be a potentiometer, hall effect sensor such as AMS AS5601, keyboard, or other input device.

There are several advantages to the embodiment of FIGS. 2 and 4. Because the stroke length of plunger 7 is controlled by aliquot motor 27 and CPU 28, the stroke can be varied based on several factors. For example, sequential aliquots need not be identical volumes as is the case for the embodiment in FIG. 3. Input/Output (I/O) device 31 can include a display and/or input device such as a keypad or touch-screen. I/O 31 can be used to instruct CPU 28 to, for example, make the first aliquot 1 ml, the second aliquot 2 ml, the third aliquot 4 ml, etc. CPU 28 then adjusts the stroke length by control of aliquot motor 27.

Since the relationship between the stroke length of piston 7 and aliquot volume dispensed can be nonlinear, the CPU 28 can adjust the stroke length to provide a more accurate delivery. For example, if a 10 mm displacement of plunger 7 provides a delivery of 1 ml, a 1 mm displacement may not yield a delivery of 0.1 ml, but rather 0.098 ml due to factors such as the "dead volume" of air between the fluid in pipette 1 and piston 7. In this case the CPU can increase the stroke length to compensate. The amount of compensation can be determined empirically or by mathematical formula. The CPU can then either access the proper compensation by a look-up table or mathematical calculation.

According to embodiments, greater accuracy of the aliquot volume can be attained by using nozzle pressure sensor 32, atmospheric pressure sensor 33, and chamber pressure sensor 34. These pressure sensors can be, for example, BMP280 (Bosch Sensortec, Reutlingen/Kusterdingen, Germany). These are accurate sensors that can be interfaced to CPU 28 via an interface commonly used in microprocessors such as the Inter-Inter Circuit protocol (I2C) or Serial Peripheral Interface Bus (SPI). Nozzle pressure sensor 32 provides a measurement that is virtually identical to the pressure above the fluid column in pipette 1. The difference between this pressure and atmospheric pressure is related to the weight of fluid in pipette 1. Since most fluids used in laboratories are aqueous, the difference in pressure readings between nozzle pressure sensor 32 and atmospheric pressure sensor 33 is directly related to the volume of fluid in pipette 1. In an example, a user can aspirate 25 ml into pipette 1 using aspirate control 15. A desired aliquot volume is selected using I/O 31 and then the user can depress aliquot control 29 for each desired aliquot. If a 1 ml aliquot is selected, the remaining volume in pipette 1 will decrease by 1 ml for each aliquot. As pipette 1 empties with each aliquot, the amount of injected air required to accurately deliver 1 ml changes. By employing the difference between nozzle pressure sensor 32 and atmosphere pressure sensor 33, the CPU 28 can compute the fluid volume remaining in pipette 1, and instruct aliquot motor 27 to provide the correct amount of air to dispense 1 ml accurately. The amount of air for proper delivery can be determined experimentally and then looked-up in a table or calculated using methods disclosed in U.S. Pat. No. 10,189,018, herein incorporated by reference in its entirety. Chamber pressure sensor 34 can be employed to measure the exact amount of air delivered when plunger 7 compresses the air in chamber 21, and hence the amount of air delivered to pipette 1.

Figure 6:
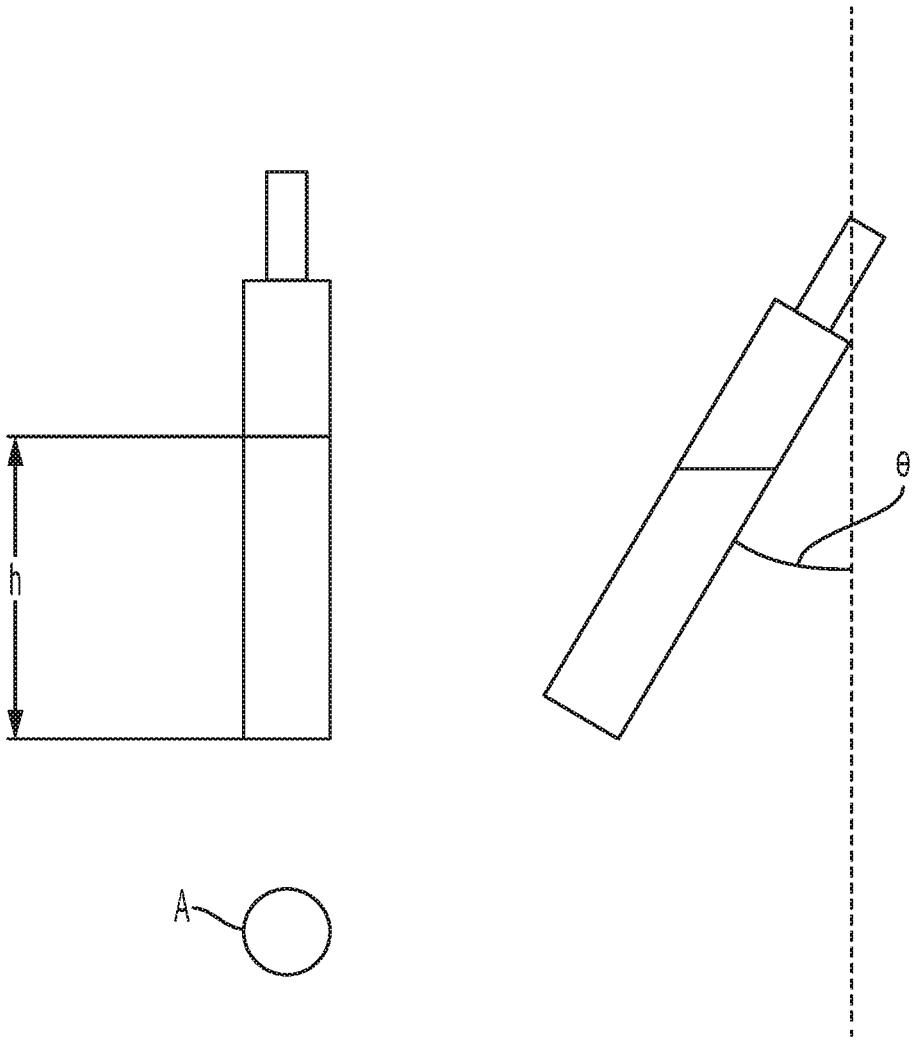
FIG. 6 is a schematic diagram of serological pipette at an angle.

A serological pipette is often held at a substantial angle relative to vertical in order to deliver media into a cell culture flask or for other applications. Holding pipette 1 at an angle relative to vertical changes the pressure measured by nozzle pressure sensor 32 for a given volume of fluid in the pipette. An orientation sensor 35 such as LIS2DHTR (STMicroelectronics, Geneva, Switzerland) or equivalent can measure the angle at which pipette 1 is held. This sensor can inform the CPU 28 of the orientation of pipette 1 via an interface such as I2C or SPI as mentioned above, and the CPU can correct for the angle of pipette. (See FIG. 6). At vertical, nozzle pressure equals the weight of the fluid divided by the area of the pipette:

$$\text{Nozzle Pressure}=mgh/A$$

where m=mass of the fluid
g=universal gravitation constant=9.8 m/sec2
h=height of the fluid column
A=cross sectional area of pipette 1

When the pipette is held at an angle from vertical, the force (weight) of liquid in the pipette is reduced by the cosine of the angle. So the corrected pressure is:

$$\text{Nozzle Pressure(corrected)}=(mgh/A)\cos\theta$$

Where θ is the angle relative to vertical.

Figure 5:
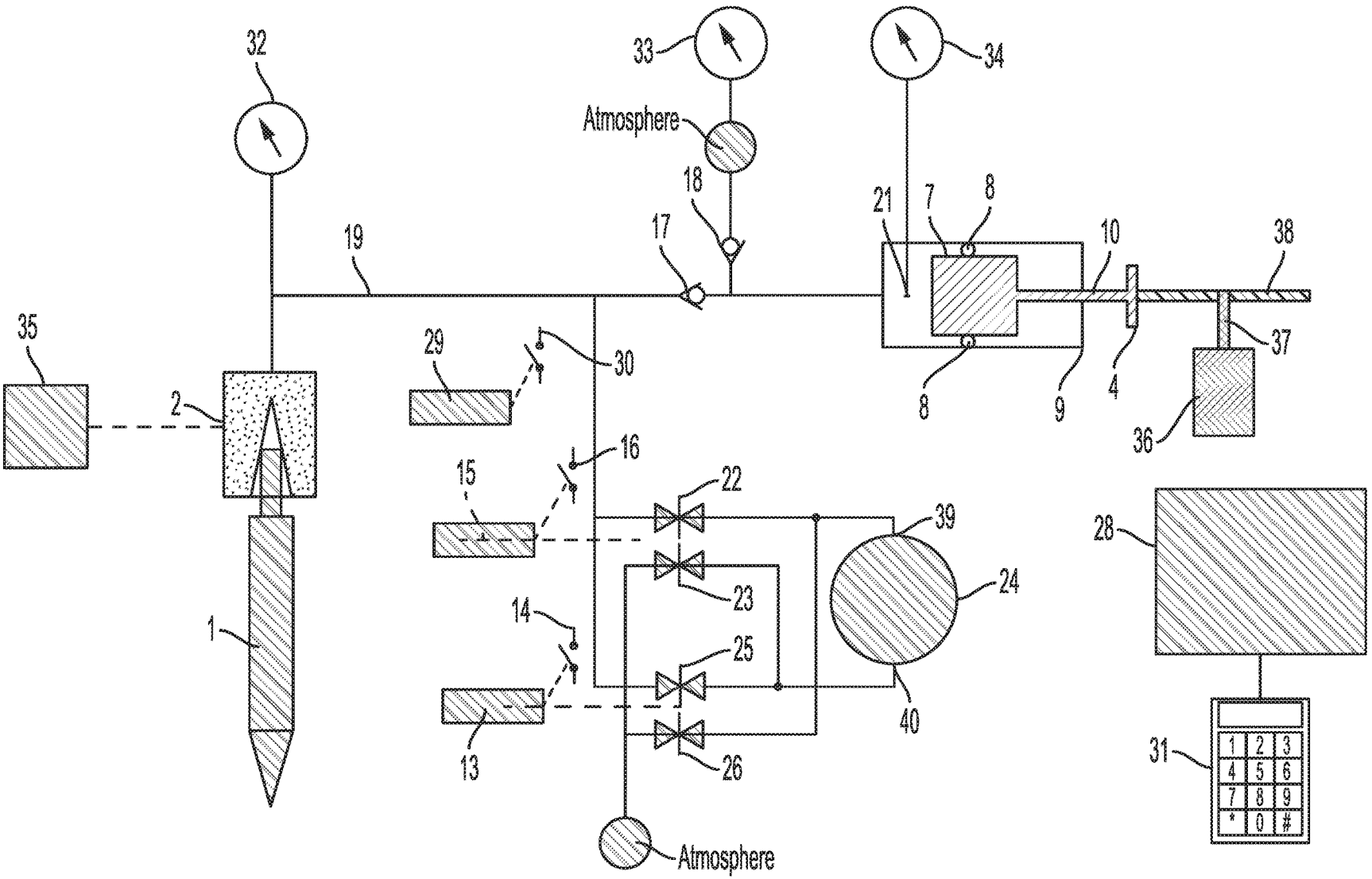
FIG. 5 is a schematic diagram of another motor driven embodiment.

FIG. 5 shows a variation on the embodiment of FIG. 4 by using a different motor drive for plunger 7. According to an embodiment, motor 36, which can be a small DC motor, rotates cam 38 via motor shaft 37. The cam and plunger stroke are selected such that a single rotation of the cam causes a full stroke of plunger 7. Displacing plunger 7 causes an aliquot to be delivered as described above. According to an embodiment, the stroke length and diameter of plunger 7 are chosen such that a relatively small volume is displaced, for example 0.05 ml. In order to aliquot 1 ml of fluid, cam 38 can, for example, nominally make 20 full rotations. The number of rotations can be changed for the aliquot volume desired. Additionally, a fractional rotation can be used for further modification of the aliquot dispensed using any of the methods described above.

Additional Embodiments

A person skilled in the relevant art will recognize that the scope of the invention is not limited to pipette controllers, and that the components and configurations can be used in additional applications without departing from the spirit and scope of the invention. According to an embodiment, the components and configurations can be used in, for example, a bottle top dispenser. In other embodiments, the configurations and methods can be used in robotic pipetting systems. Previous robotic pipetting systems were limited by their requirement to change pipette capacity and/or the size of pipette tip to aspirate and dispense a range of volumes greater than 5:1. However, an embodiment of an apparatus using the components and methods described herein can attain excellent repeatability and accuracy in dispensing aliquots without needing to adjust for the size of the pipette over approximately a 100:1 range of volumes. According to an embodiment, the components and methods described herein can be used for remote controlled volume adjustment and aliquotting. A person skilled in the art will further recognize that the components and configurations disclose herein can be used in other applications that require quick, accurate, and/or repeat dispensing of fluids.

While various embodiments of the present invention have been described above, it should be understood that they have been presented by way of example only, and not limitation. Thus, the breadth and scope of the present invention should not be limited by any of the above-described embodiments, but should instead be defined only in accordance with the following claims and their equivalents.

What is claimed:

1. A pipette controller comprising:
a pipette holder adapted to operatively connect a pipette to the pipette controller;
a pump having a vacuum port and a pressure port, the pump pneumatically connected to the pipette holder;
an aspirate valve that controls airflow between the vacuum port and the pipette holder;
a dispense valve that controls airflow between the pressure port and the pipette holder;
a piston chamber;
an aliquot dispense pump including a piston having a shaft that extends into the piston chamber, the shaft defining a stroke length; and
an aliquot check valve that connects the pipette holder and the aliquot dispense pump; wherein
the aliquot check valve opens to allow airflow into the pipette holder upon engagement of the aliquot dispense valve;
a piston chamber pressure sensor that determines air pressure inside the piston chamber;
an atmospheric pressure sensor that determines atmospheric air pressure; and
a pipette pressure sensor that determines pipette air pressure.

2. The pipette controller of claim 1, wherein the stroke length is defined by a movable threaded stop located on the shaft.

3. The pipette controller of claim 2, further comprising:
a threaded stop control, wherein the threaded stop control is rotatable to move the threaded stop.

4. The pipette controller of claim 3, further comprising:
an aspirate check valve that connects the piston chamber to an atmosphere; wherein
the aspirate check valve opens to allow airflow from the atmosphere into the piston chamber.

5. The pipette controller of claim 1, further comprising:
a stepper motor that drives the aliquot dispense pump.

6. The pipette controller of claim 5, further comprising:
an aliquot volume control operable to select an aliquot volume; and
a processor; wherein
the processor controls the stepper motor to deliver a number of steps required for the selected aliquot volume.

7. The pipette controller of claim 6, wherein:
the processor controls the stepper motor to deliver successive aliquots.

8. The pipette controller of claim 7, wherein:
the successive aliquots are of different aliquot volumes.

9. The pipette controller of claim 1, wherein:
the pipette controller corrects the number of steps required for a selected aliquot volume based on the air pressure of at least one of the piston chamber pressure sensor, the atmospheric pressure sensor, or the pipette pressure sensor.

10. The pipette controller of claim 9, wherein:
the number of steps is determined by a value in a lookup table.

11. The pipette controller of claim 9, wherein:
the number of steps is calculated by formula.

12. The pipette controller of claim 6, further comprising:
an orientation sensor that measures an angle of the pipette connected to the pipette holder relative to vertical;

wherein the pipette controller corrects the number of steps required for a selected aliquot volume based on the angle of the pipette.

13. The pipette controller of claim 1, wherein:

the pipette controller is a handheld device.

* * * * *